US005570737A

United States Patent [19]

Tokutake

[11] Patent Number: 5,570,737

[45] Date of Patent: Nov. 5, 1996

[54] HEAT EXCHANGER

[75] Inventor: Toshinori Tokutake, Oyamashi, Japan

[73] Assignee: Showa Aluminum Corporation, Osaka, Japan

[21] Appl. No.: 509,809

[22] Filed: Aug. 1, 1995

Related U.S. Application Data

[63] Continuation of Ser. No. 134,027, Oct. 7, 1993, abandoned.

[51] Int. Cl.[6] ..... F28F 9/02

[52] U.S. Cl. ..... 165/67

[58] Field of Search ..... 165/67, 173, 175; 180/68.4

[56] References Cited

U.S. PATENT DOCUMENTS 5,069,275 12/1991 Suzuki et al. ..... 165/149 X
5,092,398 3/1992 Nishishita et al. ..... 165/173 x
5,172,762 12/1992 Shinmura et al. ..... 165/173
5,205,349 4/1993 Nagao et al. ..... 180/68.4 X
5,240,068 8/1993 Tokutake ..... 165/173 X

FOREIGN PATENT DOCUMENTS 0070994 3/1991 Japan ..... 165/67

*Primary Examiner*—John C. Fox

[57] ABSTRACT

A heat exchanger has tubes inserted in headers easily to a given depth, and also has brackets which are readily attached to the headers. Each of the headers (3, 4) is divided into an inner half (5) and an outer half (6) facing the inner half in which apertures (5*a*) for receiving ends of the tubes are formed. The bracket (12) having a fastenable rib (12*c*) is fitted on the header over its halves (5, 6) so that these halves are made immovable relative to each other. Alternatively, the outer half (6) of the header may have a pair of embracing portions (12*a*) which fit on lateral sides of the inner half (5) so as to hold it in place.

13 Claims, 15 Drawing Sheets

HEAT EXCHANGER

This application is a continuation, of application Ser. No. 08/134,027, filed Oct. 7, 1993, now abandoned.

BACKGROUND OF THE INVENTION

1. Field of the Invention

The present invention relates to a heat exchanger for use as a condenser or evaporator for instance in car air conditioners, or for use as a radiator or the like.

2. Description of Prior Art

The heat exchangers of the so-called header type are now widely used as the condensers or the like for instance in the car coolers. Each heat exchanger of this type comprises a plurality of flat tubes and corrugated fins which are stacked one on another, and both ends of each tube are connected to a pair of hollow headers in fluid communication therewith.

The headers incorporated in such a heat exchanger are manufactured from a brazing sheet, or alternatively, one-piece-extruded pipes. In the former case, the brazing sheet is composed of a core having either or both sides clad with a brazing agent layer, and one sheet of a given dimension is bent to form a cylinder whose lateral edges abut against and tightly adjoined to one another.

A row of tube-insertion apertures are formed through the periphery of each header at regular intervals longitudinally of the header. The ends of the flat tubes are inserted in those apertures to a regulated depth, and are brazed thereto to be integral therewith. The tube ends must not be inserted too deep or too shallow relative to the diameter of the header.

It is however not necessarily easy to arrange the tube ends all at the regulated depth in the header in order to exactly assemble the heat exchanger. A proposal which was made to resolve this problem is disclosed in the Japanese Utility Model Laying-Open Gazette Sho. 63-80492. This prior art method of regulating the inserted depth of tubes employs a header which has an internal stopping ridge protruding from the tube's inner surface. The stopping ridge has a height midway in diametrical direction and extends a full length longitudinally of the header, so that all the tube ends bear against this ridge and align with one another at regulated insertion depth. This hollow header of such a peculiar cross-sectional shape can be extruded smoothly, but is not free from a certain problem. It is noted in this connection that the integrally adjoining of the inserted tubes and a bracket or the like to the header is generally carried out most efficiently by the one-shot brazing method. Therefore, it is preferable to employ as the header a pipe whose inner and/or outer peripheral surfaces are coated with a brazing agent layer. Such a pipe coated with that layer is however considerably difficult to extrude, from a technological point of view. Further, it is not easy to extrude a pipe composed of a relatively thin wall, thus failing to reduce the weight of the pipes as one part of a lighter heat exchanger. The work for exactly and rapidly boring the tube-insertion apertures in the pipe wall is also troublesome, due to a likelihood that the pipes tend to collapse when bored, thus impairing manufacture efficiency. Further, the internal stopping ridge present within the header will hinder an inlet and/or outlet pipes from being connected at desired portions of the header.

The heat exchangers of the described type are usually mounted on a larger rigid object such as an automobile car, by means of brackets attached to the headers. The brackets have been welded, brazed or otherwise secured to the headers. In the case of brazing, those brackets are temporarily set in place by suitable jigs before being subjected to the one-shot brazing process together with other parts of the heat exchanger. Thus, an intricate operation has been necessary for rigidly attaching the brackets to the headers.

OBJECTS AND SUMMARY OF THE INVENTION

In view of the described problems, a first object of the present invention is to provide a heat exchanger such that its tubes can be inserted in its headers easily and surely to a regulated depth thereof, in order to improve production efficiency.

A second object of the invention is to provide a heat exchanger comprising headers to which brackets can be attached without any difficulty.

From a first aspect of the invention, the heat exchanger comprises at least one bracket in addition to headers each composed of coupled longitudinal halves, with one of them receiving the inserted tubes, wherein the bracket comprises an embracing portion which fits on and holds in place the coupled halves, and the bracket's portion and the halves are integrally adjoined one to another.

From a second aspect, each of the headers is composed of coupled longitudinal halves, with one of them receiving the inserted tubes wherein the outer half comprises an embracing portion which fits on and holds in place the inner half.

The present invention thus provides, from the first aspect, a heat exchanger comprising: a plurality of tubes arranged in parallel with each other; at least one hollow header having a row of tube-insertion apertures in which ends of the tubes are inserted; at least one bracket attached to the header; the header being composed of an inner and outer halves facing one another; the tube-insertion apertures being bored in the inner half; the bracket comprising: an embracing portion and a fastenable rib, wherein the embracing portion of the bracket fits on the header and their inner ends extend inwardly over the adjoined halves of the header so that the header is embraced immovable by the embracing portion and fixedly adjoined thereto.

It is preferable that the embracing portion of the bracket has an inner surface tightly fittable on the periphery of the header. The embracing portion preferably further comprises at least one tube-contacting extension protruding from the embracing portion so as to be in contact with a side surface of at least one tube. The extension is preferably of a shape closely contactable with the side surfaces of the tube so that the bracket in engagement with the header is surely prevented from any displacement therearound. It will be convenient that the bracket is made by simply extruding aluminum.

Since the longitudinal halves for example those which are semicircular in cross section ) of the header are brazed one another, desirably at the same time when the bracket is brazed to the header within an oven, it will be advantageous that the halves are composed of a core sheet having either or both sides covered with a brazing agent layer.

The invention also provides, from the second aspect, a heat exchanger which comprises: a plurality of tubes arranged in parallel with each other; and at least one hollow header having a row of tube-insertion apertures in which ends of the tubes are inserted, the header being composed of: an inner half in which the tube-insertion apertures are bored; and an outer half arranged to face and be adjoined to the inner half; the outer half comprising: a pair of embracing portions fitting on both lateral sides of the inner half; and an outwardly protruding fastenable rib, wherein the inner and outer halves facing one another are held in place by the embracing portions adjoined to the inner half of the header.

It is preferable that the embracing portion of the outer half of the header has an inner surface tightly fittable on the periphery of the inner half. At least one tube-contacting extension which will come into contact with side surfaces of the tubes may protrude from the embracing portion.

Since the longitudinal halves of the header are brazed one another, desirably at the same time when the tubes are brazed to the inner half within an oven, it will be advantageous that the inner half is composed of a core sheet having either or both sides covered with brazing agent layer. It will be convenient if the outer half of the header is made by simply extruding aluminum.

For insertion of the tube ends into the header provided in the invention and from its first aspect, the inner half of the header may be laid on a plane support such that its tube-insertion apertures do face outwards remote from the plane support, and then the tube ends may be forced in the apertures until stopped by the plane support. Next, the outer half of the header may be coupled with the inner half of the header so that their edges abut against one another to form the header. Such a manner of operation enables easy and sure regulation of the inserted depth of the tube ends.

When assembling the heat exchanger, any positioning jig is no longer needed to hold the bracket in place, because it closely fits on and tightly grips the coupled mating halves and thus stands itself immovable on the header during the step of brazing or otherwise adjoining the bracket to the header. Therefore, not only the assembling operation is simplified, but also a certain disadvantage which has been inherent in the positioning jig which absorbs heat to bring about an incomplete brazing of the adjacent members during the one-shot brazing in an oven will be avoided.

In a case wherein the outer half of the header has the embracing portions which fit on and grip both sides of the inner half, the number of parts constituting the heat exchanger is reduced to thereby further simplify the assembling operation.

Other objects and advantages of the present invention will become apparent from the description of preferred embodiments given below. The invention may be embodied in other specific forms without departing from the spirit or essential characteristics thereof. The following embodiments are therefore to be considered in all respects as illustrative and not restrictive, the scope of the invention being indicated by the appended claims rather than by the following description and all changes which come within the meaning and range of equivalency of the claims are therefore intended to be embraced therein.

DETAILED DESCRIPTION OF THE PREFERRED EMBODIMENTS

The present invention will now be described in detail, referring to embodiments in which a heat exchanger of the multi-flow type and made of aluminum will be provided as a condenser for use in the car air conditioning systems.

It will be understood that the present invention is applicable also to other various heat exchangers such as a condenser or evaporator for room air conditioners, a radiator, and an oil cooler, which all comprise headers. The term 'aluminum' used herein is meant to include its alloys.

Figure 1:
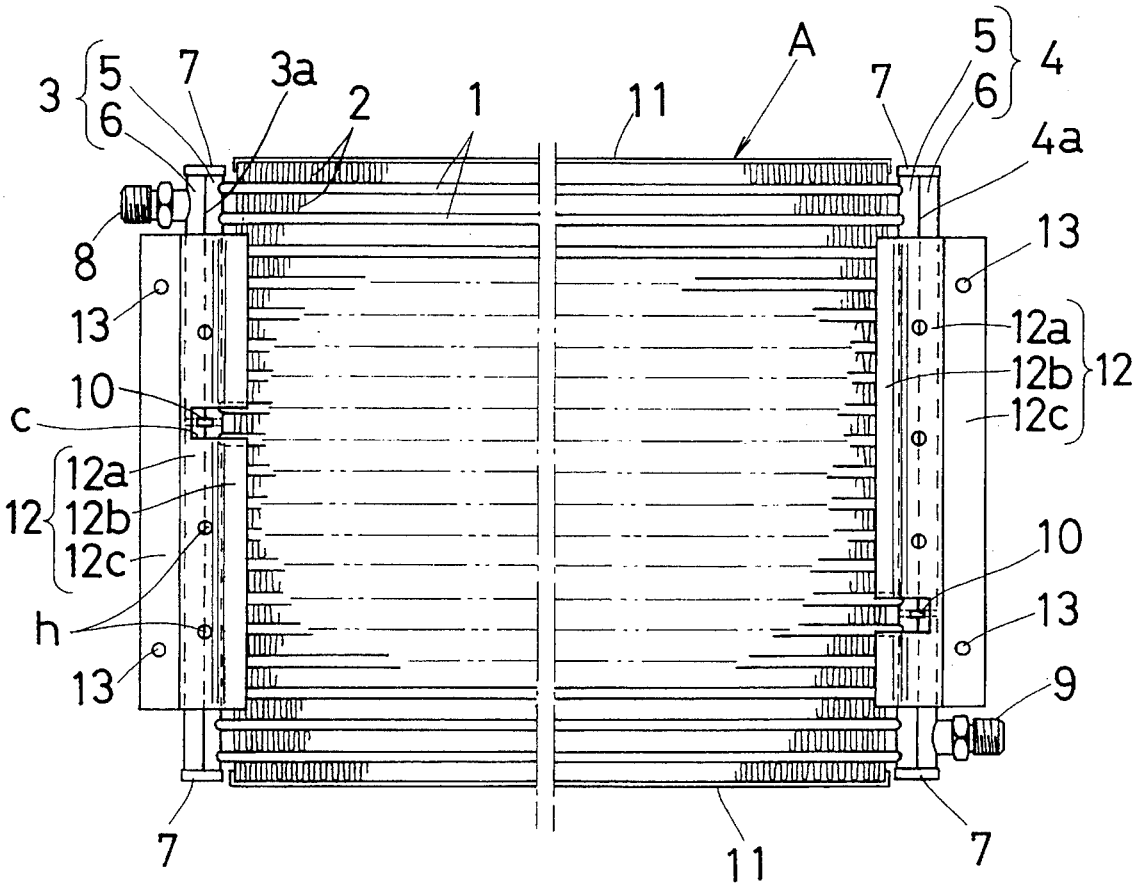
FIG. 1 is a front elevation of an entire heat exchanger provided in an embodiment of the invention.

FIG. 1 shows a heat exchanger body 'A' which comprises a plurality of flat aluminum tubes 1 arranged horizontal and stacked one on another. The heat exchanger body 'A' further comprises aluminum corrugated fins 2 each interposed between the two adjacent tubes 1 and outside the outermost tubes 1, and a pair of left and right headers 3 and 4 to which both ends of each tube 1 are connected in fluid communication.

The tubes 1 are of the so-called harmonica type made by extruding aluminum, and each comprise internal and longitudinal partitions 1*a*. The partitions 1*a* improve pressure resistance and heat conductivity of the tubes 1. Alternatively, the flat tubes 1 may be seam-welded pipes or the like, each preferably having an inner corrugated fin inserted therein to act as longitudinal partitions.

The first mentioned fins 2 brazed to the tubes 1 are made by repeatedly bending a strip of brazing sheet in a meandering manner. This brazing sheet is composed of an aluminum core which is of the same width as the tubes and has both sides coated with a brazing agent layer. It is highly preferable that a number of louvers 2*a* are opened up in each corrugated fin 2 so as to further improve heat exchange efficiency. The described corrugated fins may be replaced with thin and straight plates each having transverse slits formed at regulated intervals along one of its longitudinal edges. Those plates will be arranged at regular intervals and perpendicular to the tubes so that corresponding portions of each tube fit in the slits.

Figure 2:
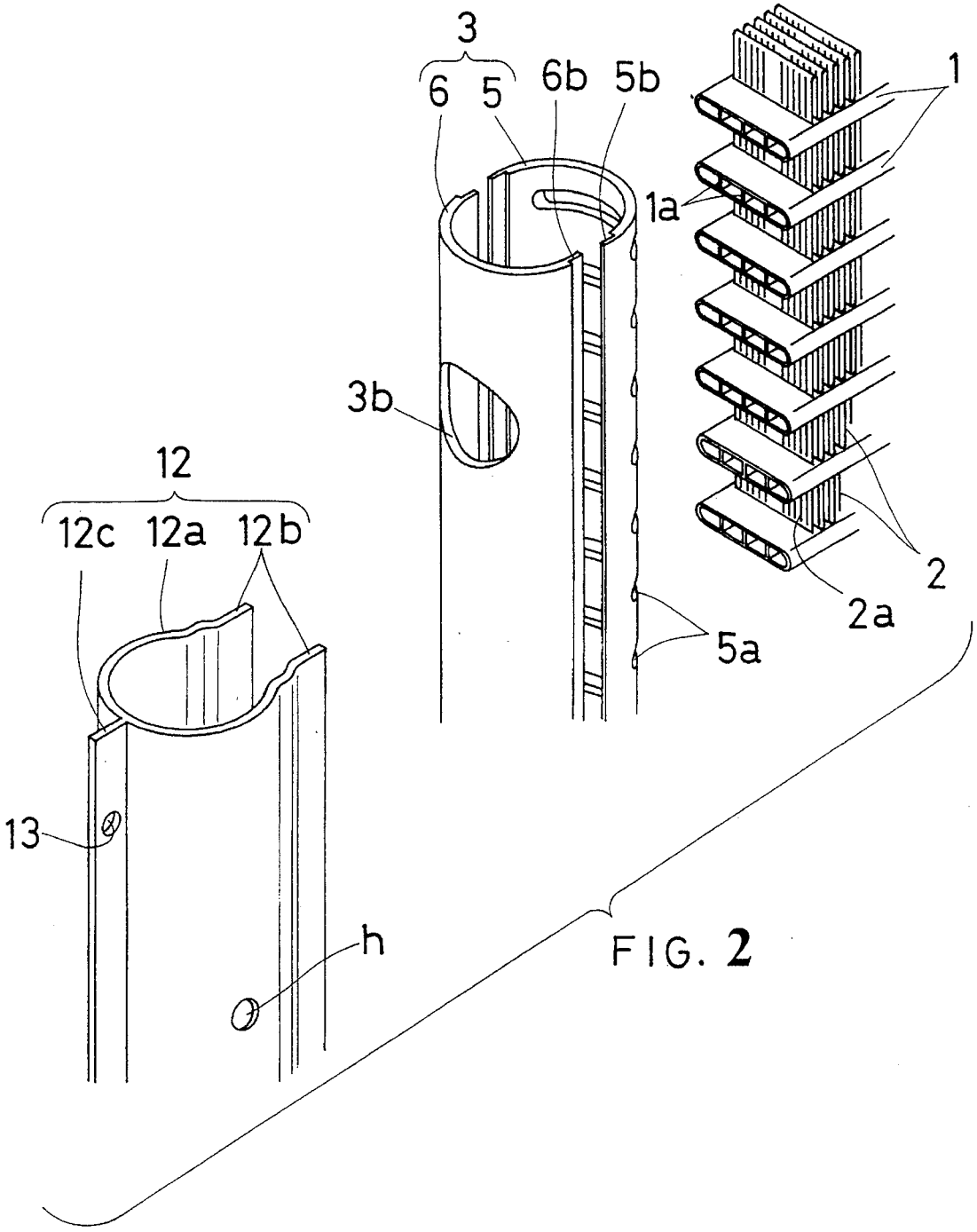
FIG. 2 is a perspective view showing, in a disassembled state, a pair of longitudinal halves of the header together with a bracket, tubes and other members.
Figure 3:
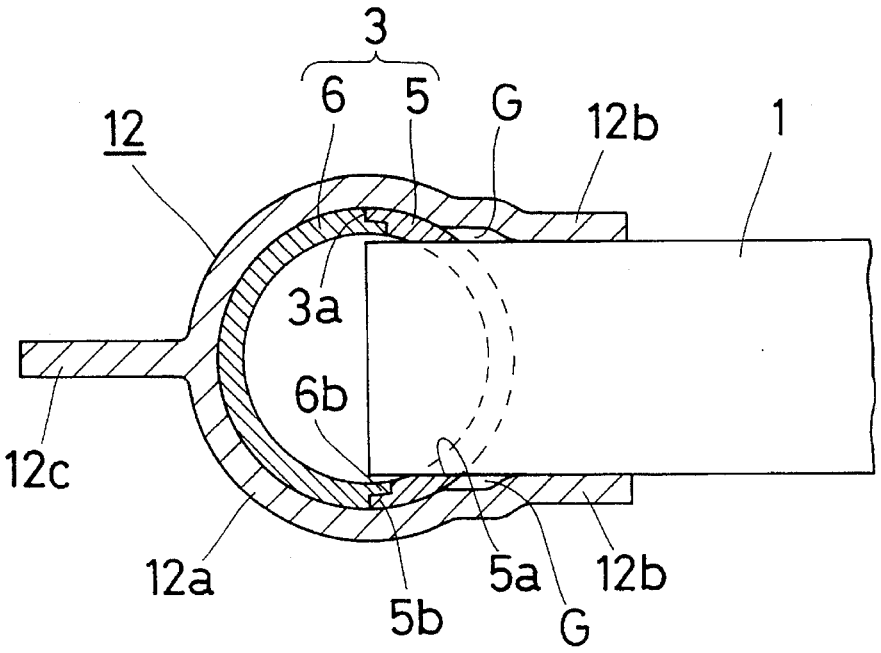
FIG. 3 is an enlarged cross-sectional view of a portion including the header.

FIG. 2 shows that the left-hand and right-hand headers 3 and 4 are each composed of an inner longitudinal half 5 and an outer longitudinal half 6. The halves are made of aluminum and face one another, with a row of tube insertion apertures 5a being bored in the inner half 5. As shown in FIG. 3, the halves 5 and 6 have their edges 5*b* and 6*b* abutting against each other. Those edges are complementarily stepped such that peripheries of the halves are flush with one another, and are liquid-tightly brazed one another. The edges 5*b* and 6*b* may however not be stepped, but flat or complementarily oblique, if desired. One of the halves of each header 3 and 4 may alternatively have edges bent to form recesses in which the corresponding edges of the other half tightly fit. Such overlapping edges will advantageously increase their contact surfaces, to thereby improve their adjoining strength.

Although the inner half 5 and the outer half 6 are substantially of the same size, they may be of different sizes if necessary. The ends of the tubes 1 can easily be inserted in the header exactly to a regulated depth depending on the size of the inner half in such a manner as will be detailed hereinafter.

Thus, the ends of the tubes 1 are inserted to the regulated depth in the inner half 5 through its apertures 5*a*, and are liquid-tightly brazed thereto.

Both the longitudinal halves 5 and 6 of the header are made by pressing a brazing sheet which is composed of an aluminum core having both sides covered with a brazing agent layer. The header made of the brazing sheet is advantageous in that the brazing of one of the halves 5 to the other half 6 of the header, the brazing of the plurality of tubes 1 to the inner half 5, the brazing of brackets 12 to the halves 5 and 6, and the brazing of an inlet pipe 8 and an outlet pipe 9 for a heat exchanging medium to the outer half 6 are all effected at the same time easily and surely in an oven.

The left-hand and right-hand headers 3 and 4 have an upper and lower ends closed with caps 7 and 7, respectively, as shown in FIG. 1. Those caps 7 gripping the outer peripheries of the header ends do contribute not only to hold the halves 5 and 6 in their mating position in an unbrazed preassembly, but also to protect the headers 3 and 4 from bursting, thus improving pressure resistance of the brazed assembly.

Fluid-tightly connected to an upper and outer side of the left-hand header 3 is the heat exchanging medium inlet pipe 8, and similarly connected to a lower and outer side of the right-hand header 4 is the outlet pipe 9. A partition 10, which is secured in the left-hand header 3 and positioned slightly above the middle thereof, divides the interior of this header into an upper and lower compartments. A further partition 10 is secured in the right-hand header 4 at about a quarter height thereof from bottom. Those partitions 10 comprise each a main portion shaped to divide the interior of each header 3 and 4, and a lockable portion extending outward from the main portion's periphery so as to be seized by the peripheral header wall. In detail, the lockable portion fits in a slot of the header wall so that the partition 10 is fixed in and liquid-tightly brazed to each header 3 and 4.

Thus, unit paths for the heat exchanging medium through the tubes are divided into three groups, that is, an upper, middle and lower groups. The heat exchanging medium enters the upper group of the paths through the inlet pipe 8 and flows successively through all the three groups in a meandering manner, before leaving this condenser through outlet pipe 9. Air streams flowing through the spaces each defined between two adjacent tubes 1 and including the corrugated fin 2 will exchange heat between it and the medium which will consequently condense. For a better performance of the condenser of this type, the cross-sectional area of the grouped paths is preferably reduced gradually towards the outlet at successive ratios corresponding to the change occurring in phase of the medium.

Disposed outside the outermost corrugated fins 2 are side plate 11 which are made of an aluminum plate substantially of the same width as the fins 2.

Elongate brackets 12 fit on and are brazed to middle portions of the respective headers 3 and 4, wherein each middle portion located intermediate the header's upper and lower ends to which the inlet or outlet pipe is connected.

Each bracket 12, which is an extruded aluminum profile in this embodiment, does comprise an embracing portion 12*a*, a pair of tube-contacting extensions 12*b* and a fastenable rib 12*c* as shown in FIGS. 2 and 3. The embracing portion 12*a* has a mouth formed as a cutout in circumference, the extensions 12*b* protrude in a forward direction from open lips of the mouth, and the rib 12*c* juts in a reverse direction from a bottom of the portion 12*a*. The portion 12*a* is of a shape closely fittable on each header 3 and 4, and is of a size to extend beyond the mating edges 5*b* and 6*b* and to thereby surround the header halves 5 and 6. Thus, these brackets 12 can firmly grasp the preassembled halves 5 and 6 of each header, whereby these halves are kept in place without using any jig and the brackets 12 automatically maintains their position on the respective headers 3 and 4.

As best seen in FIG. 3, each extension 12*b* has its basal end adjacent to the header 3 and expanded outwardly away from side surfaces of the tube 1. Therefore, small cavities 'G' are provided inside the bracket 12 and covering the tube's end inserted in the header 3 or 4. A brazing agent and a flux, which are molten when brazing the tubes to the headers 3 and 4, will be allowed to freely flow through the cavities 'G'. A sufficient fillet will thus be formed to seal up the joint of each tube 1 connected and brazed to the headers.

As shown in FIG. 1, small openings 'h' are bored in the bracket at appropriate intervals along the mating edges 5*b* and 6*b* of the header halves 5 and 6, for complete brazing thereof. Cavities similar to the abovementioned one 'G' may be substituted for the openings 'h'.

Cutouts 'c' formed in the brackets and from their inner edges facing the tubes towards their ribs are intended to expose and surely braze the partitions 10 to the headers 3 and 4.

The tube-contacting extensions 12*b* may be set in a simple contact with the respective side surfaces of the tubes 1.

Alternatively, the extensions may be in a resiliently urged contact with the tubes in order to more surely prevent the brackets from rotating around the headers 3 and 4.

Holes 13 are bored in the fastenable rib 12*c*, at regions near its upper and lower ends. Bolts or the like fastening members may engage with the apertures, for the installation of the heat exchanger body 'A' in an automobile body or the like.

Figure 7:
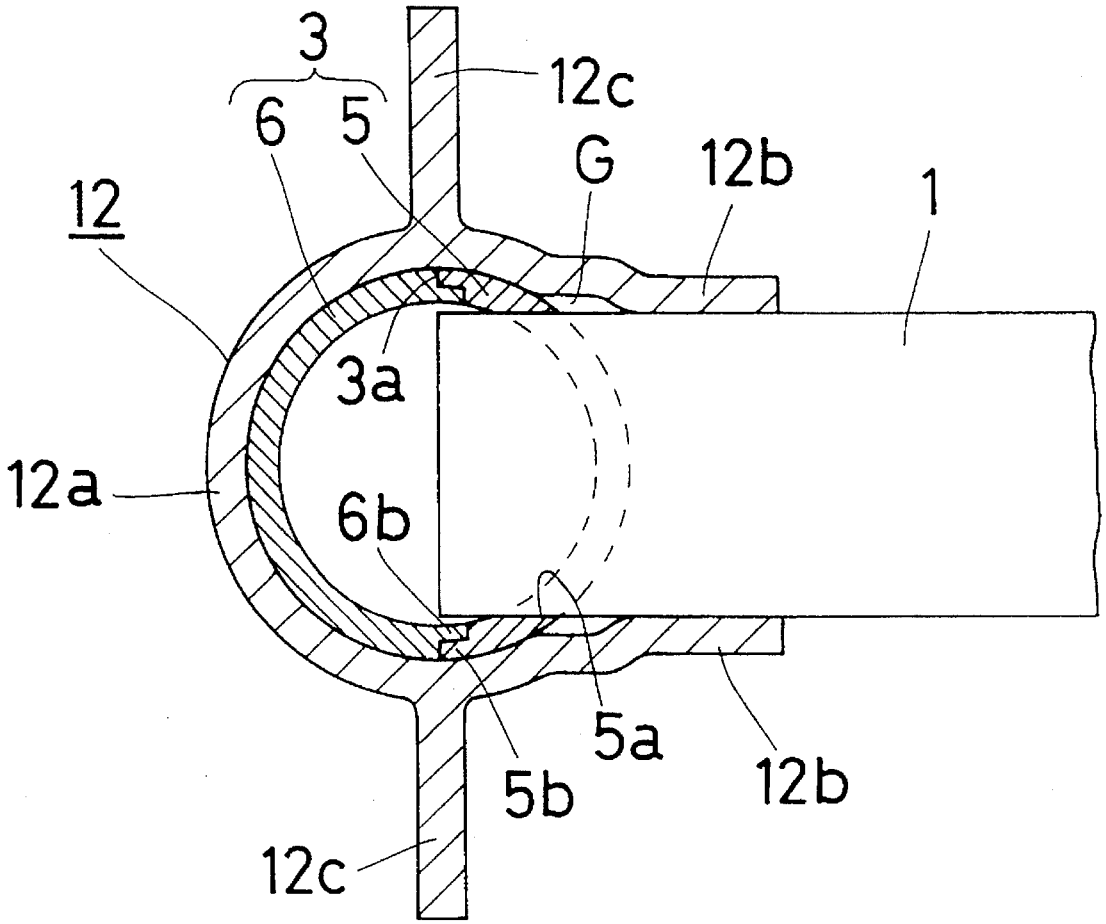
FIG. 7 is a cross-sectional view showing, corresponding to FIG. 3, a modification of the bracket.

A pair of ribs 12*c* arranged in a manner shown in FIG. 7 may be substituted for the single rib 12*c* referred to above, if necessary. Such alternative ribs 12*c* protrude sideways from the embracing portion 12*a* and perpendicular to the tube-contacting extensions 12*b*, as will be seen in FIG. 7. The location, number and/or shape of the rib or ribs 12*c* may be modified in any other manner, taking into account relevant factors. For example, it or they may not necessarily extend the full length of the portion 12*a*, but be shortened longitudinally thereof.

In any case, the embracing portion 12*a* of the bracket 12 is caused to contact an outer periphery of the header 3 or 4 and to thereby cover seams 3*a* and 4*a* each appearing between the halves 5 and 6 of each header, as already described above referring to FIG. 3. This bracket is brazed in this state to those halves so as to be integral therewith.

Conveniently, the heat exchanger in this embodiment may be assembled in a manner exemplified below.

At first, the inner half 5 of the left-hand header 3 is laid on the plane support (not shown) such that its tube-insertion apertures 5*a* do face outwards remote from the plane support. Then, one ends of tubes 1 will be put into the inner half through its apertures 5*a* until stopped by the plane support. Similarly, other ends of tubes 1 will be inserted in the inner half's apertures 5*a* of the right-hand header 4. Thus, the insertion of both ends of each tube is adjusted exactly so that they are inserted neither excessively shallow nor deep but almost midway in a diametrical direction of the header. For the condenser of this type, it is preferable that the halves 5 and 6 of the headers 3 and 4 are substantially semicircular in cross section.

Next, the outer halves 6 will be coupled with the inner halves 5 so that their edges 6*b* and 5*b* abut against one another to form the headers 3 and 4 substantially round in cross-section. Subsequent to this step, the brackets 12 will be fitted on the headers 3 and 4 so that their embracing portions 12*a* cover the seams 3*a* and 4*a* extending along the headers. In this state in which the halves 5 and 6 of each header are fixed one to another, the bracket's extension 12*b* is in contact with the side surfaces of the tubes 1, whereby any angular displacement of the bracket 12 relative to the header is avoided. The embracing portion 12*a* protects the bracket from slipping off the header.

The caps 7 for closing the open ends of each header may be attached thereto, whose halves 5 and 6 are already fixed in position by the bracket.

Then, most of the corrugated fins 2 are each interposed between the two neighboring tubes 1, with the remaining two fins being each disposed outside the outermost tubes so as to be respectively covered with the side plates 11.

Figure 4:
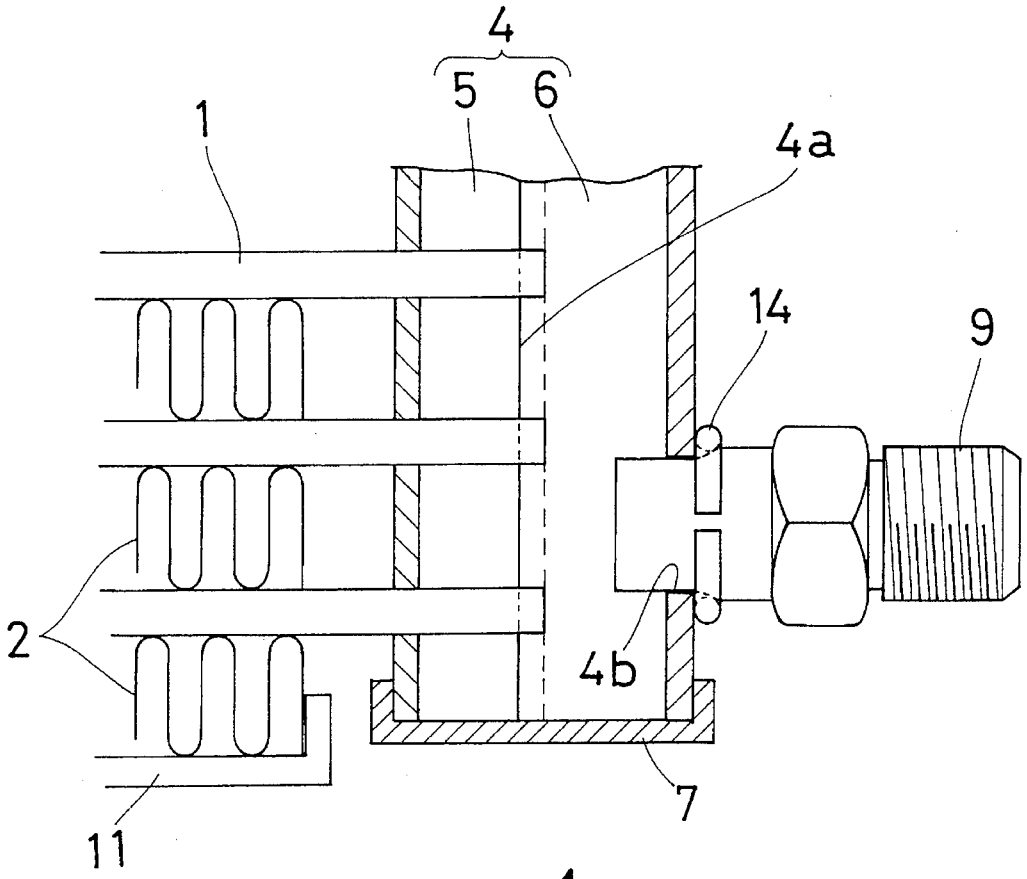
FIG. 4 is a front-elevational view showing partly in cross section an outlet pipe for a heat exchanging medium, which pipe is connected to the header but is not brazed yet thereto.
Figure 5:
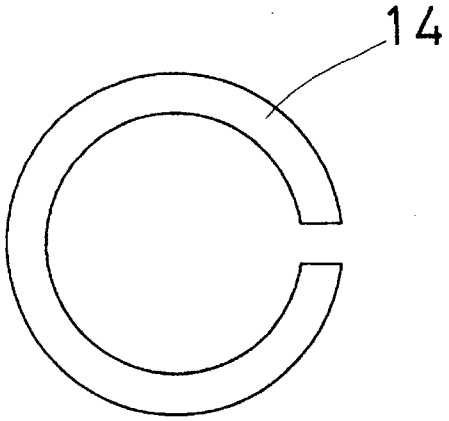
FIG. 5 is a side elevation of an auxiliary piece of a brazing agent.
Figure 6:
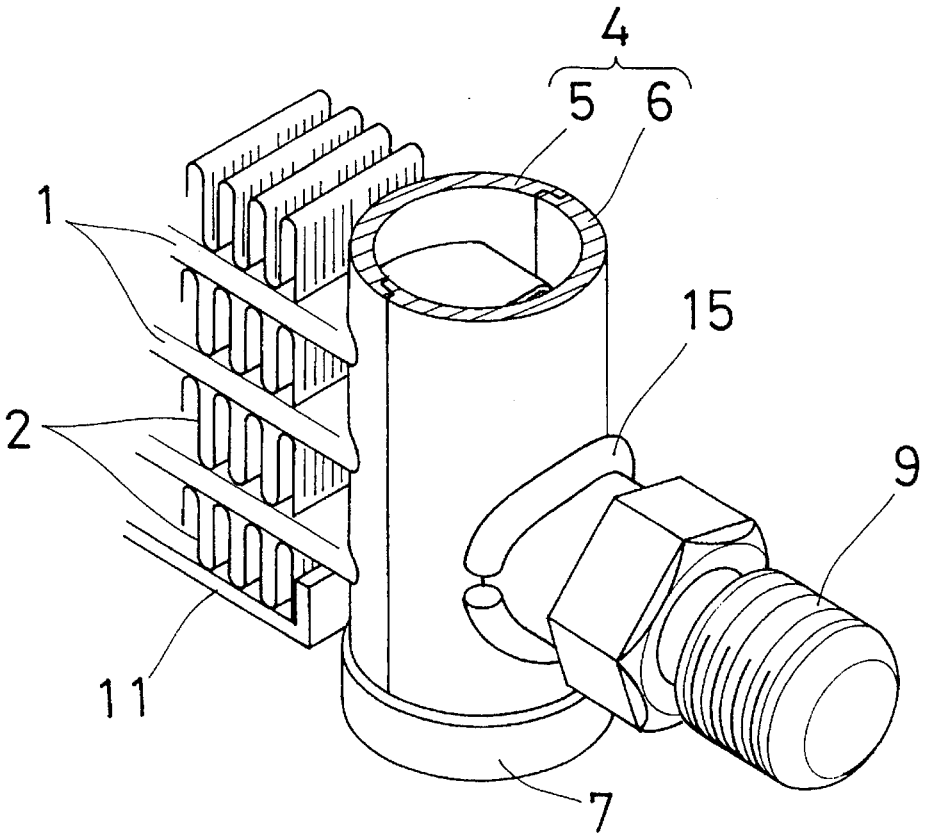
FIG. 6 is a perspective view of the auxiliary piece of a modified shape.

Further, as shown in FIG. 4, the inlet pipe 8 and the outlet pipe 9 are respectively inserted in round bores 3*b* and 4*b* of the headers 3 and 4. It is preferable that a ring-shaped elastic piece 14 of an auxiliary brazing agent shown in FIGS. 4 and 5 is then snapped on a basal end of each pipe. This annular piece 14, which is of a C-shape having a cutout, may more desirably be curved along an interstice between the pipe 8 or 9 and the header 3 or 4 receiving it. Such a peculiar shape would be useful to surely supply the interstice with the brazing agent. However, such a supplementary agent could be dispensed with if the outer half 6 of the header 4 is made of the brazing sheet composed of a core having both sides covered with the brazing agent, as is the case in this embodiment.

A preassembly of the heat exchanger, which is prepared in the described manner, will then be subjected to the one-shot brazing process within an oven.

Each bracket 12 is held in place during the brazing process, due to its extensions 12*b* in an immovable contact with the tubes 1 and due to its embracing portion 12*a* gripping the header. Therefore, heat or any other conditions of the process do not cause any displacement or slipping of brackets, but their correct position is maintained stable while they are being brazed to the headers 3 and 4.

It will now be apparent that each bracket 12, which is long enough to grip the intermediate portion of header in its entirety except for the upper and lower ends, does render the header highly pressure resistant, though it is composed of the tube-receiving inner half 5 and the outer half 6 opposite thereto.

Figure 8:
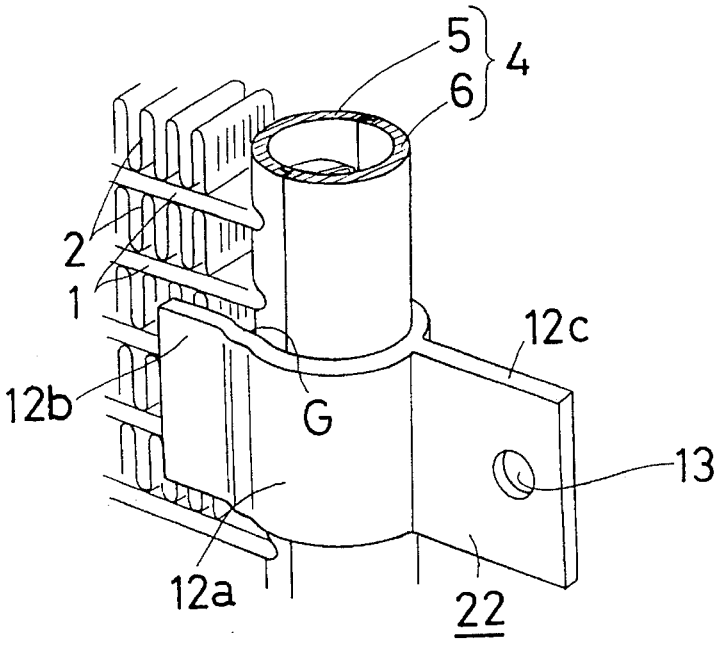
FIG. 8 is a perspective view showing another modification of the bracket.

Shorter brackets 22 shown in FIG. 8 may be substituted for the elongate one described above and attached to portions of the left- and right-hand headers 3 and 4. Each of the shorter bracket 22 may be a pressed article, but it is more preferable to sever them from an extruded infinitely long article. In this latter case, production efficiency and cost as well as precision in size and shape will be improved, and a designed strength will surely be enhanced to the cut articles. Other features of such modified brackets 22 are the same as the elongate one 12, and no further description is given on those members or portions to which the same reference numerals are allotted.

Figure 9:
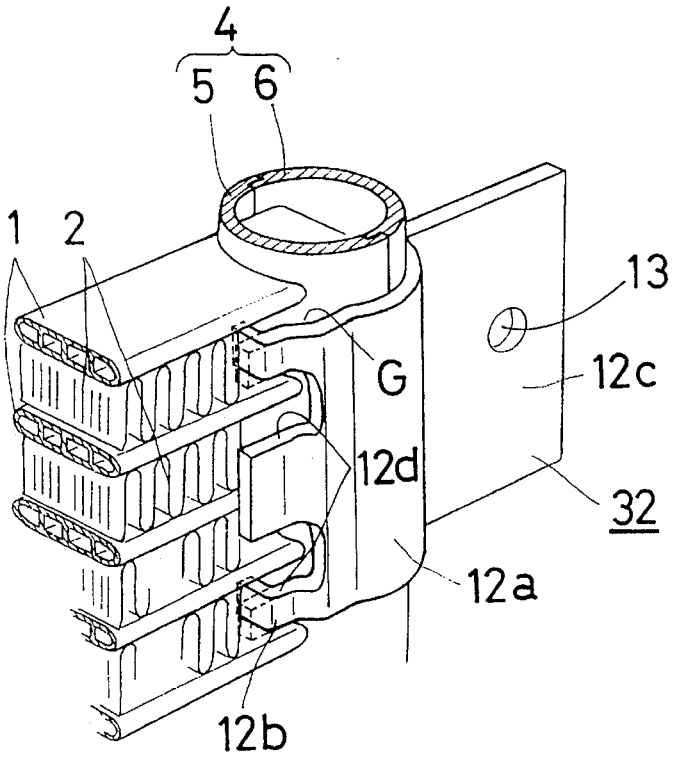
FIG. 9 is a perspective view showing, corresponding to FIG. 8, still another modification of the bracket.

FIG. 9 shows still another modification of the bracket.

This bracket 32 is similar to but somewhat longer than that 22 shown in FIG. 8, and its tube-contacting extension is divided into some sections 12*b* separated by cutouts 12*d*. Two or more tubes 1 are not covered by one such extension, but their basal ends connected to the header 3 or 4 are exposed for easier inspection and repairing of any incomplete brazing which would lower production efficiency of heat exchangers. Some of the sections 12*b* of each extension are bent inwards to hinder the bracket 32 from moving longitudinally of the header.

Other features of the modified brackets are the same as that which is shown in FIG. 8, and no further description is given of the portions to which the same reference numerals are allotted.

Figure 10:
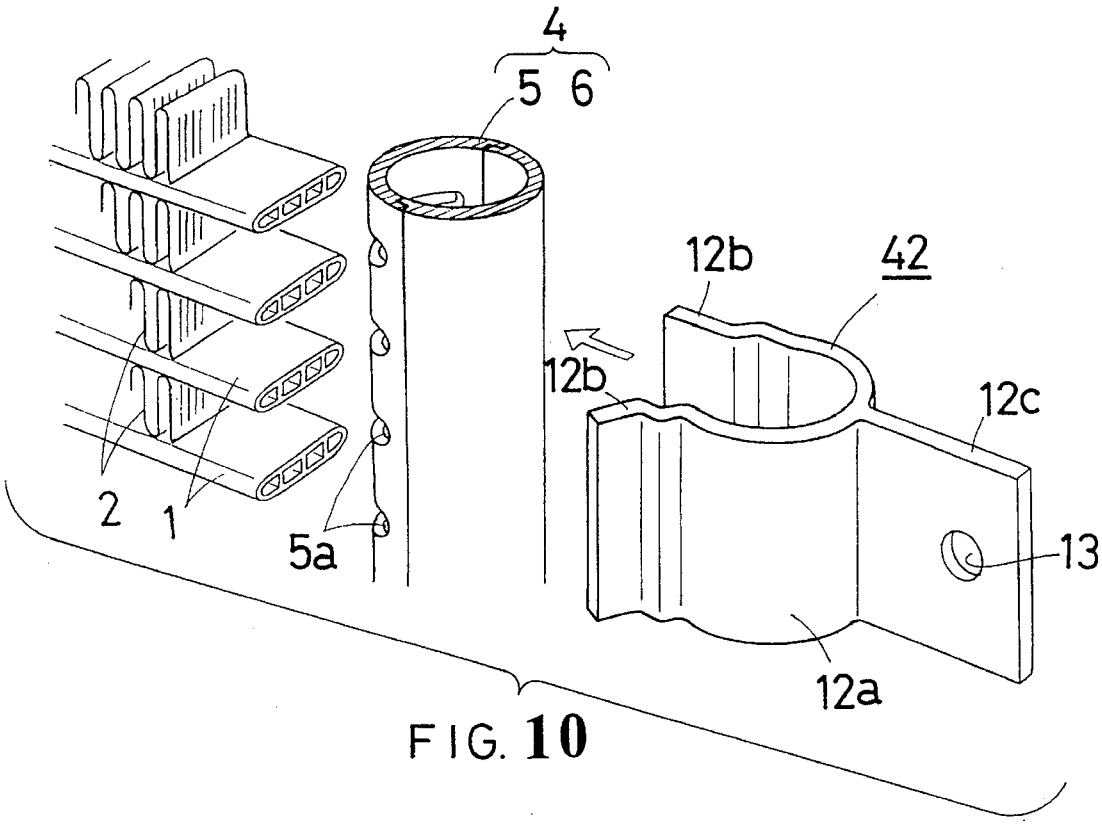
FIG. 10 is a perspective view showing yet another modification of the bracket.

FIG. 10 shows yet another modification of the bracket.

Figure 11:
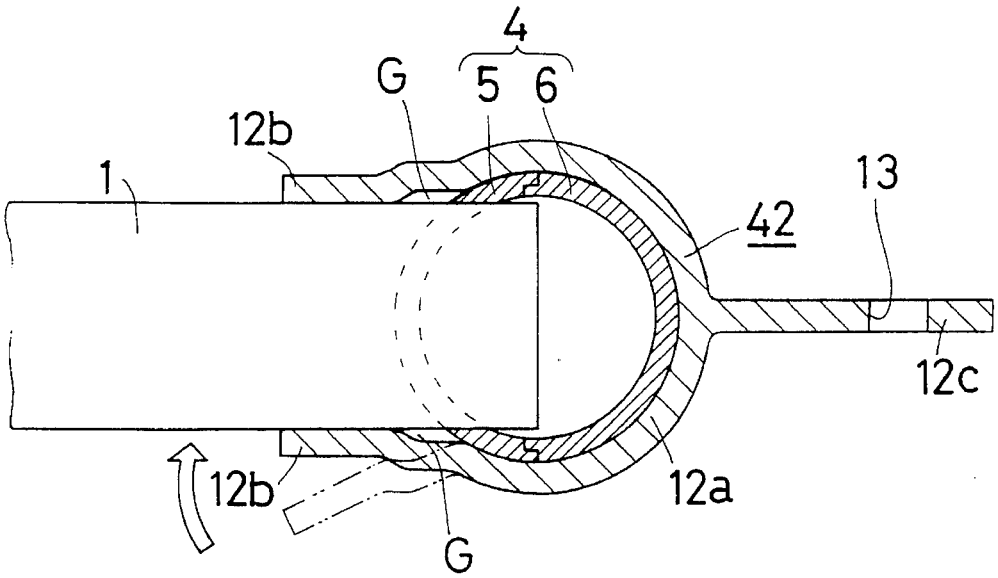
FIG. 11 is a cross-sectional view of the bracket shown in FIG. 10 and attached to the heat exchanger.

This bracket 42 also is similar to but somewhat different from that 22 shown in FIG. 8. An end of one extension 12*b* is bent away from the other so that this bracket 42 can be snapped sideways on header 3 or 4. FIG. 11 shows that the bent extension is thereafter bent reversely towards the other extension 12*b* so that they grip the tube 1 at its front and back sides. Such a configuration of the extensions 12*b* enables the bracket 42 to be brought into engagement with the header not only longitudinally but also transversely thereof, thereby simplifying the assembling operation. This bracket 42 may be a pressed article or a piece severed from an extruded elongate article.

Since other features of this bracket 42 are the same as that which is shown in FIG. 8, description of the portions to which the same reference numerals are allotted is abbreviated.

Figure 12:
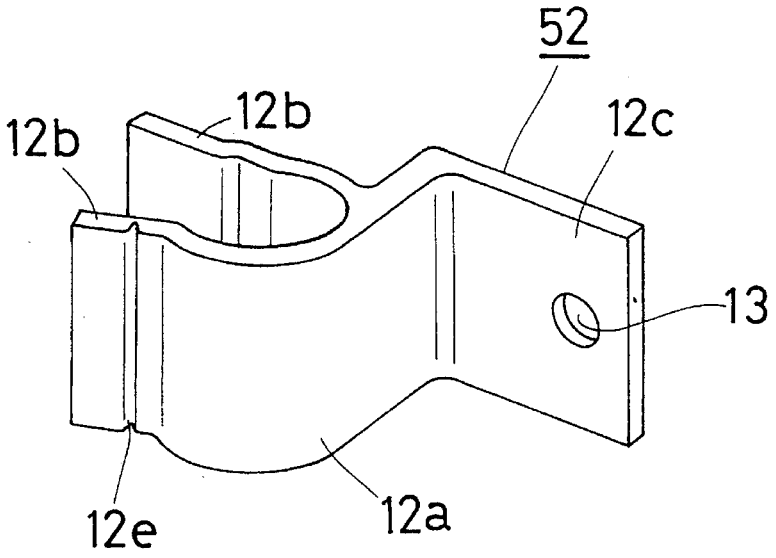
FIG. 12 is a perspective view showing the bracket in a further modification.
Figure 13:
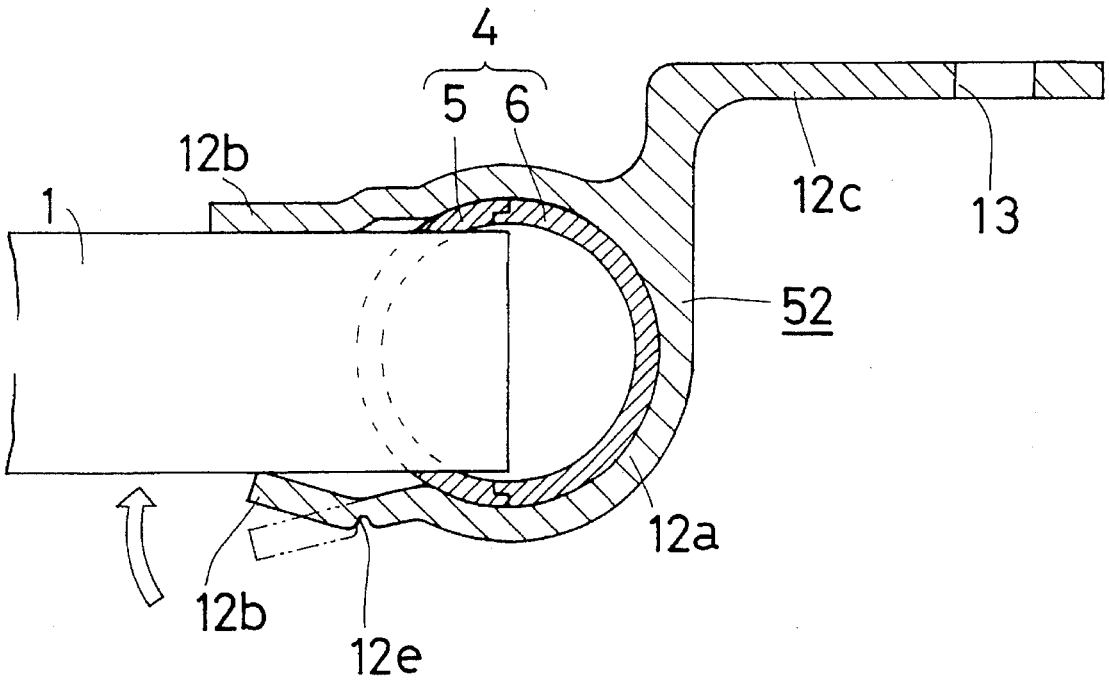
FIG. 13 s a cross-sectional view of the bracket shown in FIG. 12 and attached to the heat exchanger.

FIG. 12 shows a further modification of the bracket.

This bracket 52 is almost the same as that 42 shown in FIG. 10, except for a V- or U-shaped groove 12*e* along which the extension 12*b* is to be bent. Due to this groove, the bent extension 12*b* can easily be bent reversely towards the other extension so that they grip the tube 1 at its front and back sides. This bracket 52 may be a pressed article or a piece severed from an extruded article, and the groove 12*e* may be formed after fabrication of, or simultaneously with extrusion of the bracket. The fastenable rib 12*c* of this bracket 52 is offset relative to its embracing portion

12*a* and toward one side of the tube 1.

Since other features of this bracket 42 are the same as that which is shown in FIG. 10, description of the portions denoted by the same reference numerals is abbreviated.

Figure 14:
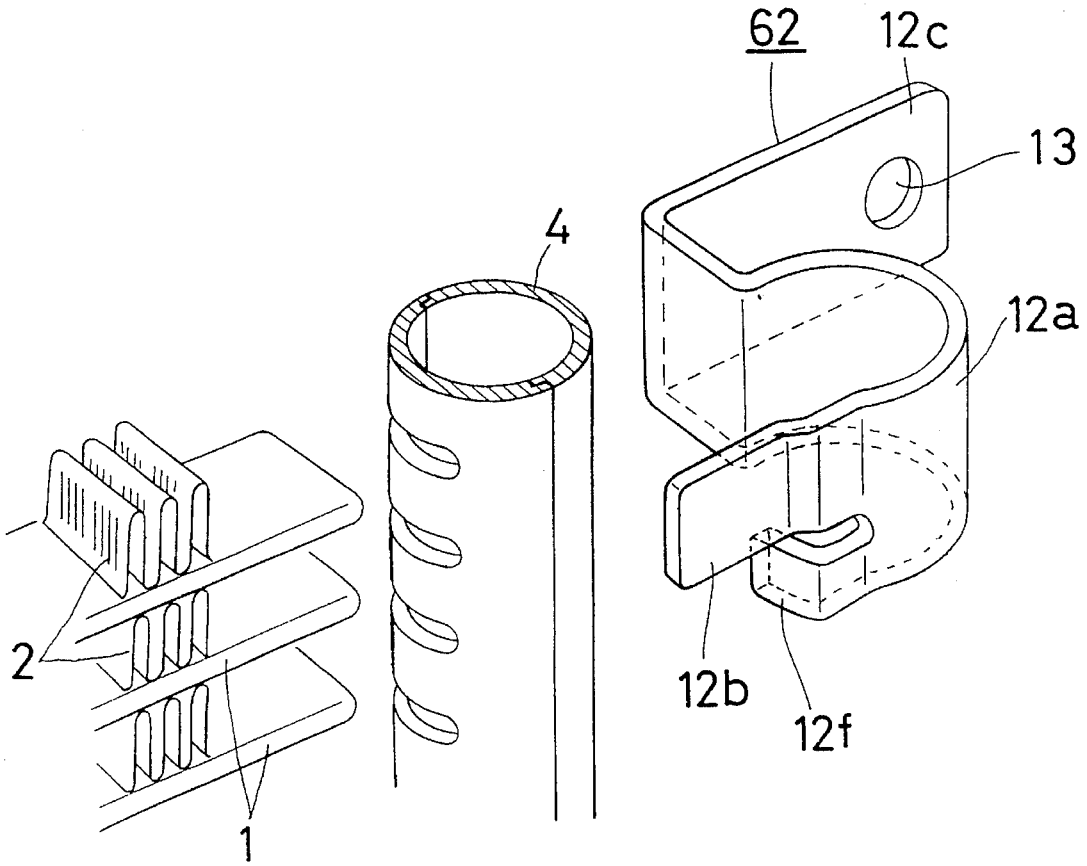
FIG. 14 is a perspective view showing the bracket in a still further modification.

FIG. 14 illustrates a still further modification of the bracket.

Figure 16:
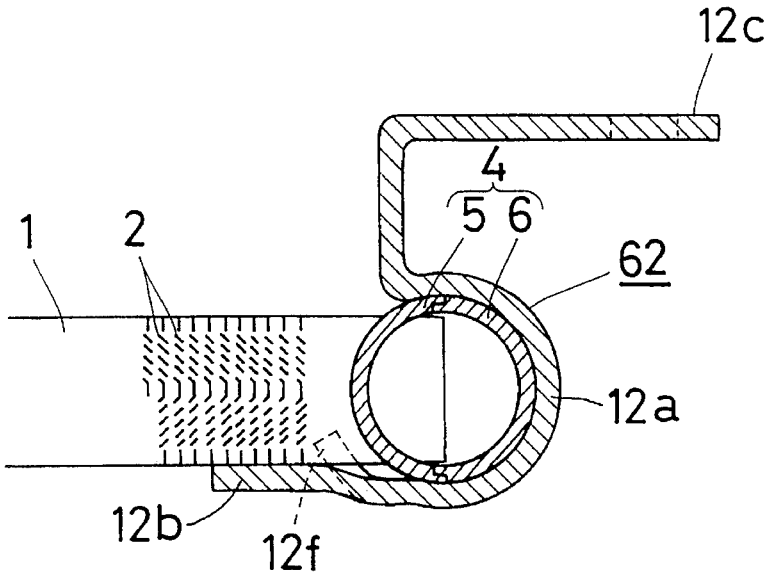
FIG. 16 is a cross-section taken along the line 16—16 in FIG. 15.

This bracket 62 is a pressed article of aluminum sheet, and comprises: an embracing portion 12*a*; a tube-contacting extension 12*b*; a fastenable rib 12*c* and a finger 12*f*, all integral with one another. The embracing portion 12*a* is arcuate corresponding to the periphery of the header 3 or 4 as shown in FIG. 16. Thus, said portion 12*a* surrounds the header, in a surface contact therewith over its semicircumference, so as to cover seams 3*a* and 4*a* which extend along the mating edges of header halves ( see FIG. 1 ).

Figure 15:
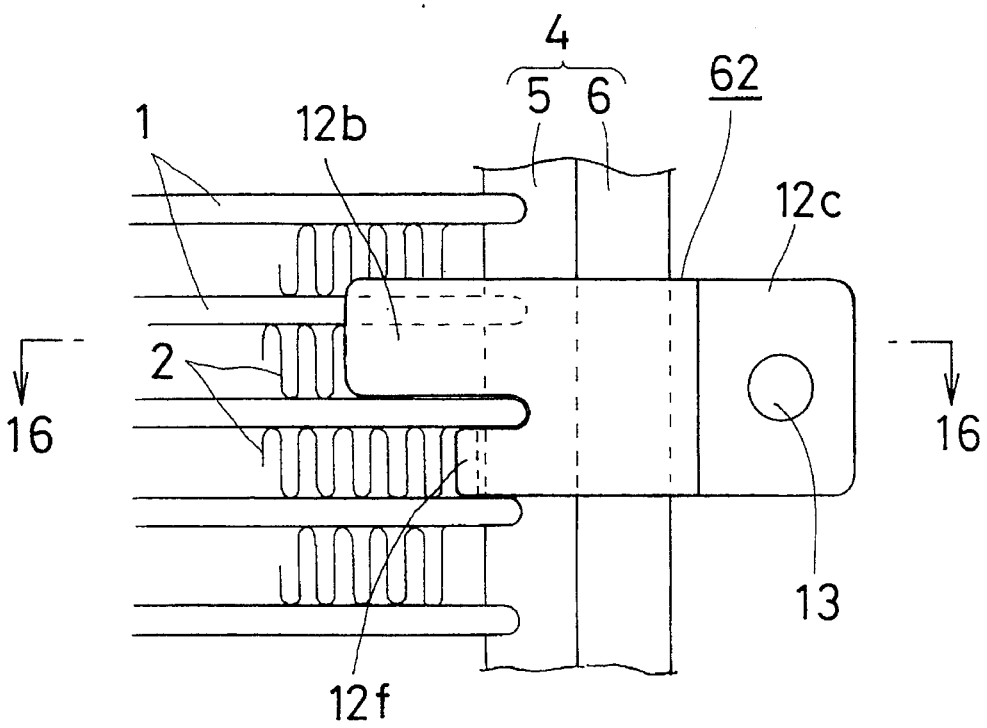
FIG. 15 is a front elevation of the bracket shown FIG. 14 and attached to the heat exchanger.

The extension 12*b* and the finger 12*f*, which protrude from a circumferential end of the portion 12*a* and integral therewith, are arranged up and down in parallel with one another. The finger 12*f* is of a width such that its end can be forced into a space between the tubes 1. As shown in FIGS. 15 and 16, an end of the extension 12*b* contacts a side of one tube 1 when the finger 12*f* is put in the space between adjacent tubes, to thereby control the insertion depth of said finger.

The rib 12*c* integral with another end of the embracing portion 12*a* extends away from the tubes 1, and the numeral 13 denotes a hole used to attach this bracket.

Figure 17:
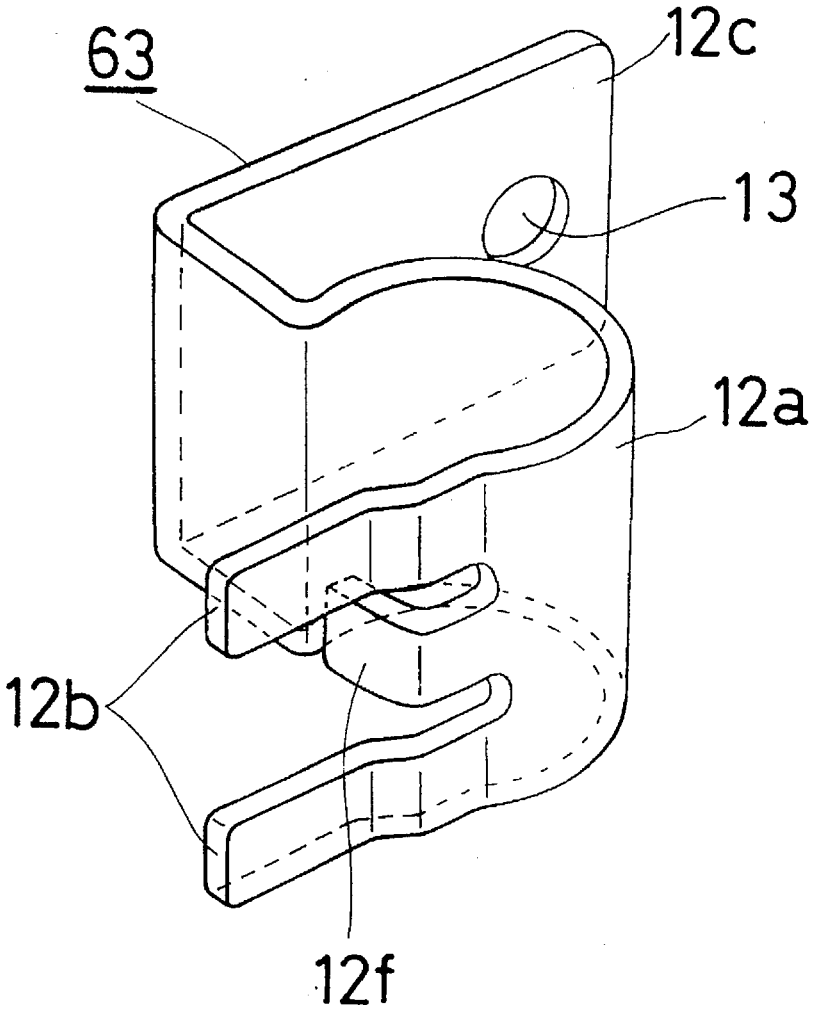
FIG. 17 is a perspective view showing the bracket in a yet further modification.

In a yet further modification in FIG. 17, the bracket 63 comprises two extensions 12*b*, with one of them located above the single finger 12*f* and the other below it, both for contact with the tubes. The extensions ends contact the sides of tubes 1 adjacent to two other tubes which define between them a space for receiving the finger forced thereinto. Since other features of this bracket 63 are the same as that 62 which is shown in FIG. 14, description of the portions denoted by the same reference numerals is abbreviated.

Figure 18:
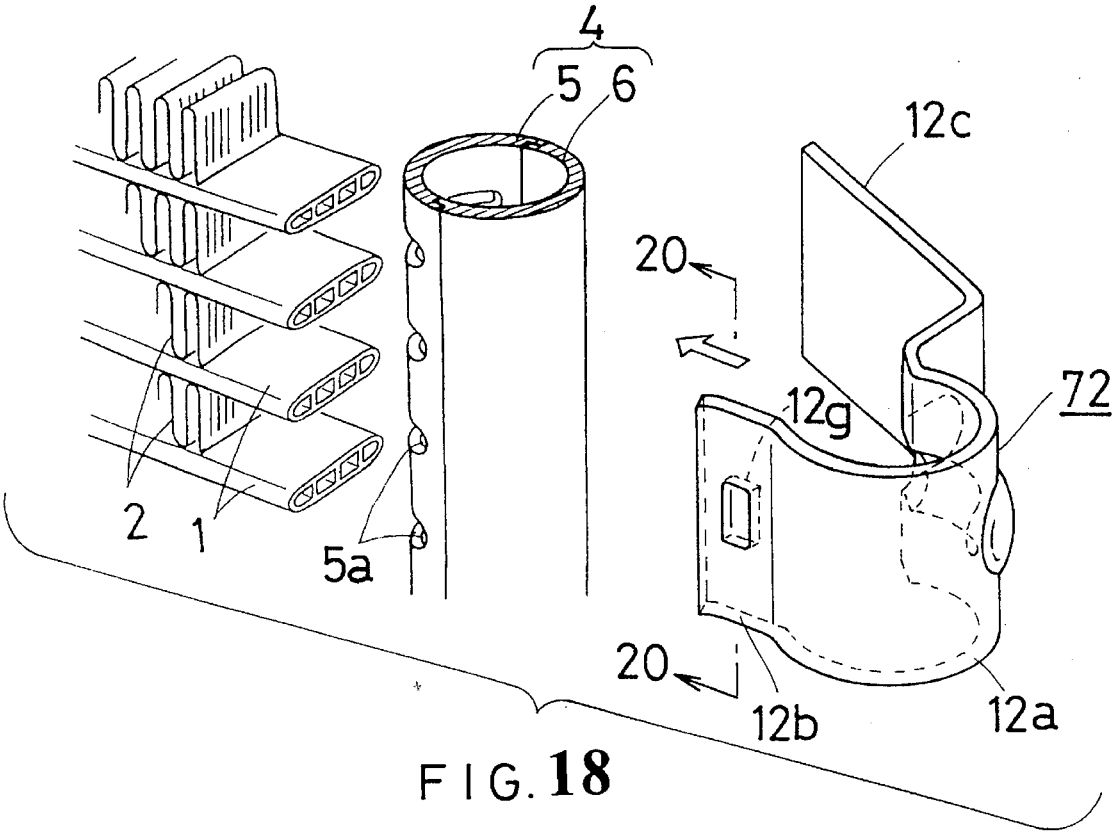
FIG. 18 is a perspective view showing the bracket in a yet still further modification.

FIG. 18 shows a yet still further modification of the bracket.

This bracket 72 is a pressed article of aluminum sheet, and comprises: an embracing portion 12*a*; a tube-contacting extension 12*b*; and a fastenable rib 12*c*. The embracing portion 12*a* tightly surrounds the header 4, over its semicircumference, with the extension 12*b* being almost plane and protruding from a linear end of the embracing portion. The rib 12*c* protrudes from another linear end of said portion 12*a*.

A positioning lug 12*g* is formed by pressing a central portion of the extension so as to protrude inwardly therefrom and to be forcibly fitted in a space defined between the adjacent tubes 1, the corrugated fin 2 and the header 3 or 4.

The bracket 72 may be fabricated by extruding an elongate profile deficient in the protrusions, severing the profile into several pieces and then pressing each piece to form said protrusion 12*g*.

Figure 19:
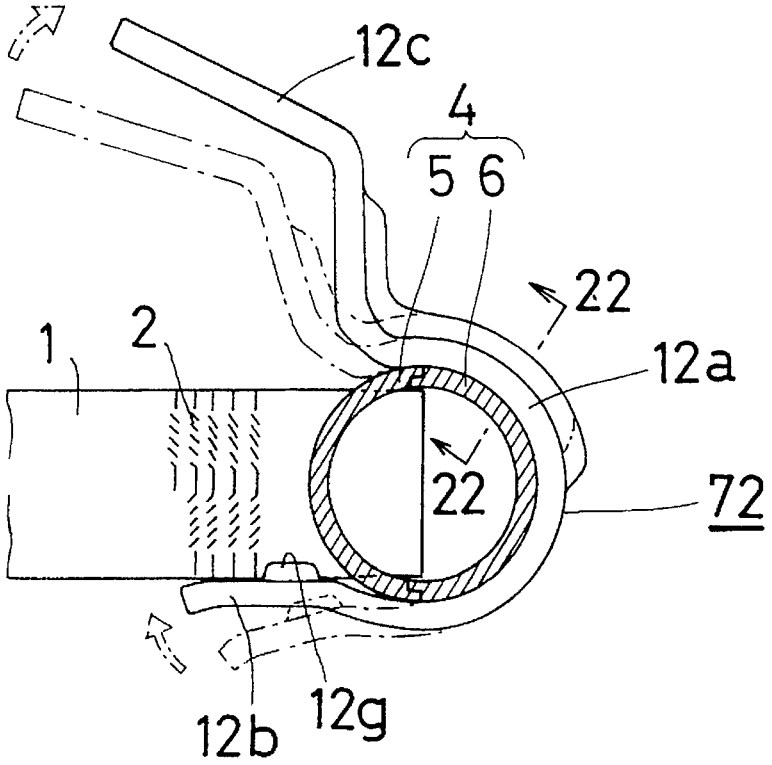
FIG. 19 is a cross-sectional view of the bracket shown in FIG. 18 and attached to the heat exchanger.
Figure 20:
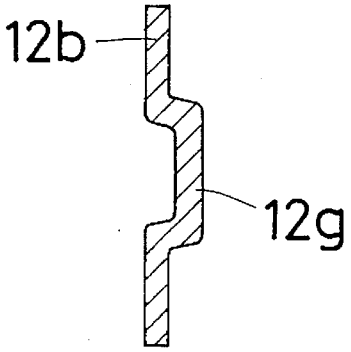
FIG. 20 is an enlarged cross-section taken along the line 20—20 in FIG. 18 and showing a positioning protrusion.

The bracket 72 may be attached to the header in the following manner as shown in FIG. 19. The header 3 or 4 will be inserted in the embracing portion 12*a* so that the latter is fixed to a given position of the former. Then, the portion 12*a* of the bracket will be rotated around the header until the extension 12*b* comes into contact with the sides of the tubes 1, with the lug 12*g* being simultaneously forced into the abovementioned space between those tubes.

In this state of the attached bracket 72, its portion 12*a* embraces the header 3 or 4 over its semicircumference so that the halves thereof are temporarily engaged with one another and at the same time the bracket retains itself on the header. The lug 12*g* fitted in the space between the tubes 1 prevents the bracket from moving longitudinally of the header, and the thus fitted lug 12*g* will cooperate with the extension 12*b* contacting the sides of the tubes so that this bracket 72 is hindered from rotating around the header whereby said bracket can retain itself on thereon.

This preassembly will be put in a brazing oven so that all the members of the heat exchanger, including the bracket 72, are one-shot brazed to each other.

Figure 21:
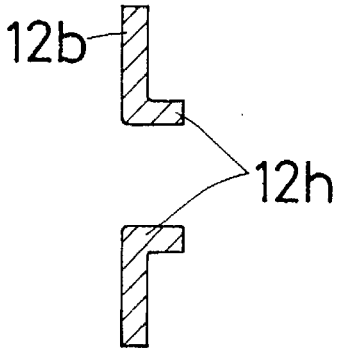
FIG. 21 is a cross-section corresponding to FIG. 20 but showing a modified positioning protrusion.
Figure 22:
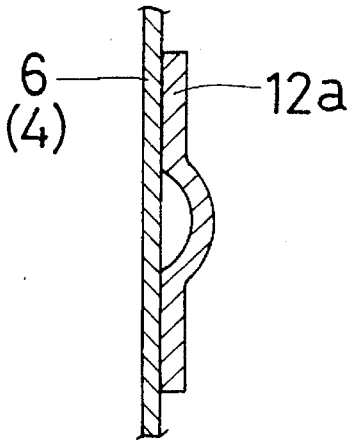
FIG. 22 is a cross-section taken along the line 22—22 in FIG. 19.

The positioning lug 12*g* may be replaced with any other regulating portion such as upright low edges 12*h* which are pressed up in the extension, as shown in FIG. 21, insofar as they can inhibit the bracket from being displaced along the header.

Figure 23:
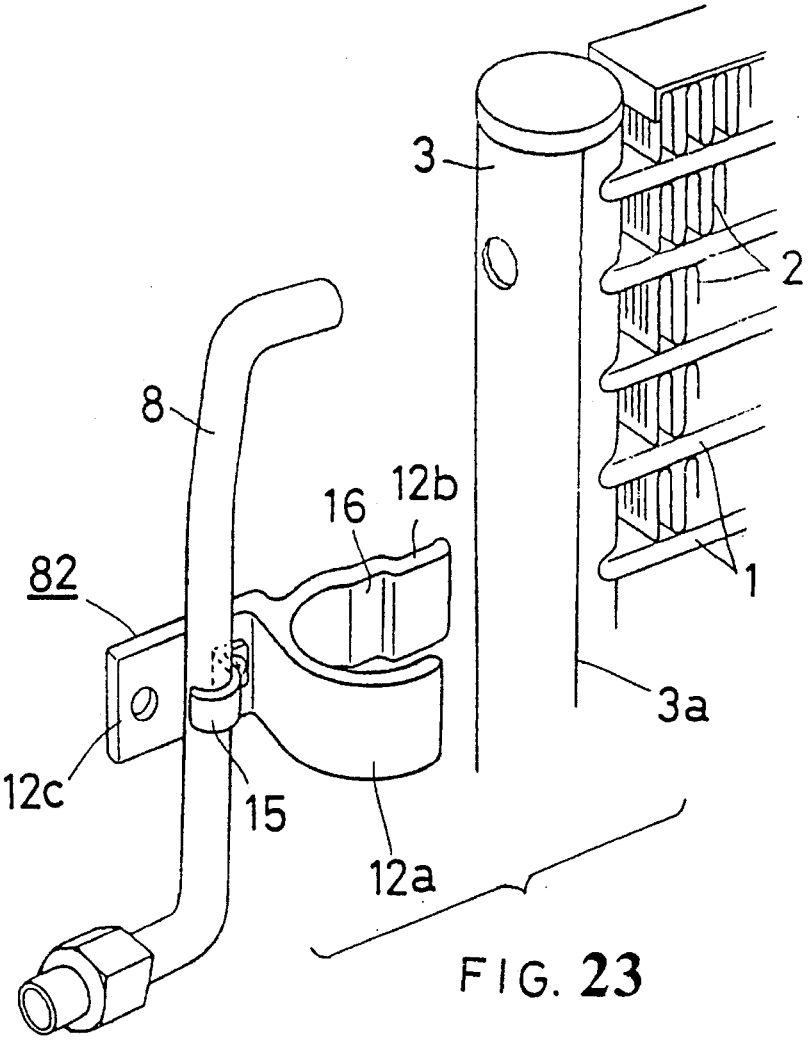
FIG. 23 is a perspective view showing a still further modified bracket in combination with an inlet pipe for the heat exchanging medium.

FIG. 23 illustrates a modified inlet pipe 8 in combination with a correspondingly modified bracket.

In this example, the inlet pipe 8 flowing the heat exchanging medium is elongate and has a basal end connected to an upper portion of the left-hand header 3 in the heat exchanger body 'A'. This pipe is bent at its basal end portion to extend along the header 3.

The modified bracket 82 carried by the header 3 is used to mount the heat exchanger body 'A' on an automobile body or the like and also to grip the pipe 8 at its intermediate portion.

Figure 24:
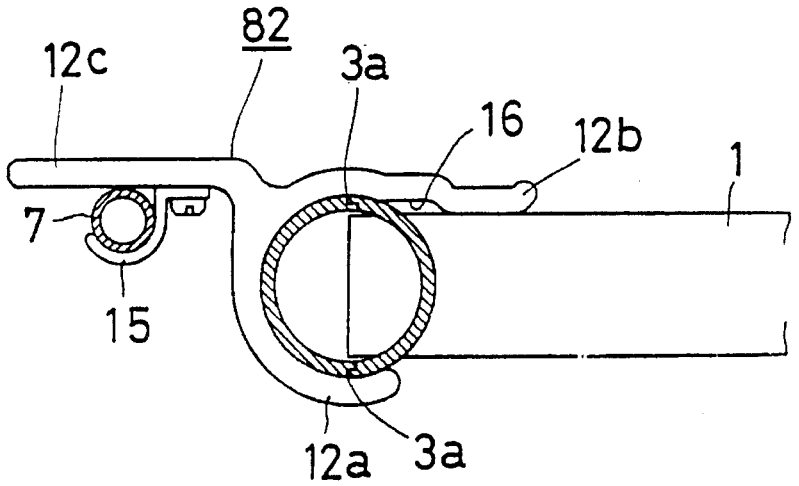
FIG. 24 is a cross-section showing the heat exchanger portion to which the bracket shown in FIG. 23 is attached.

This bracket 82 is an extruded piece of aluminum, and comprises: an header-embracing portion 12*a* substantially C-shaped in cross section; a tube-contacting extension 12*b* protruding from an end of the portion 12*a*; and a fastenable rib 12*c* substantially in alignment with, but extending in a direction opposite to the extension. The embracing portion 12*a* is in a surface contact with and integrally brazed to the outer periphery of header 3, over its semicircumference and covering a seam 3*a* between the mating longitudinal edges of the header halves as shown in FIG. 24. A clamp 15 which is bolted to the rib 12*c* secures the inlet pipe 8 thereto. The extension 12*b* regulates the position of the bracket 82 when it is set in place on the header 3 by engaging the embracing portion 12*a* with it. The bracket 82 will then be rotated clockwise around the header 3, until the extension 12*b* collides with the tubes 1 to disable any further rotation of the bracket. On the other hand, the vertical position of this bracket 82 which is to be set correct around the header 3 in the described manner, will be determined such that the extension 12*b* contacts at least one tube 1.

A tip end of the extension 12*b* is rounded and slightly bent outwards away from the tubes 1 so that they are protected from damage possibly caused by contact with the tip end.

A cavity 16 is formed adjacent to a basal end of the extension 12*b* and facing a boundary between the header 3 and the tubes 1 connected thereto. This cavity 16 permits a sufficient amount of a molten brazing agent to flow said boundary, thus ensuring a strong adjoining of the tubes to the header.

Figure 25:
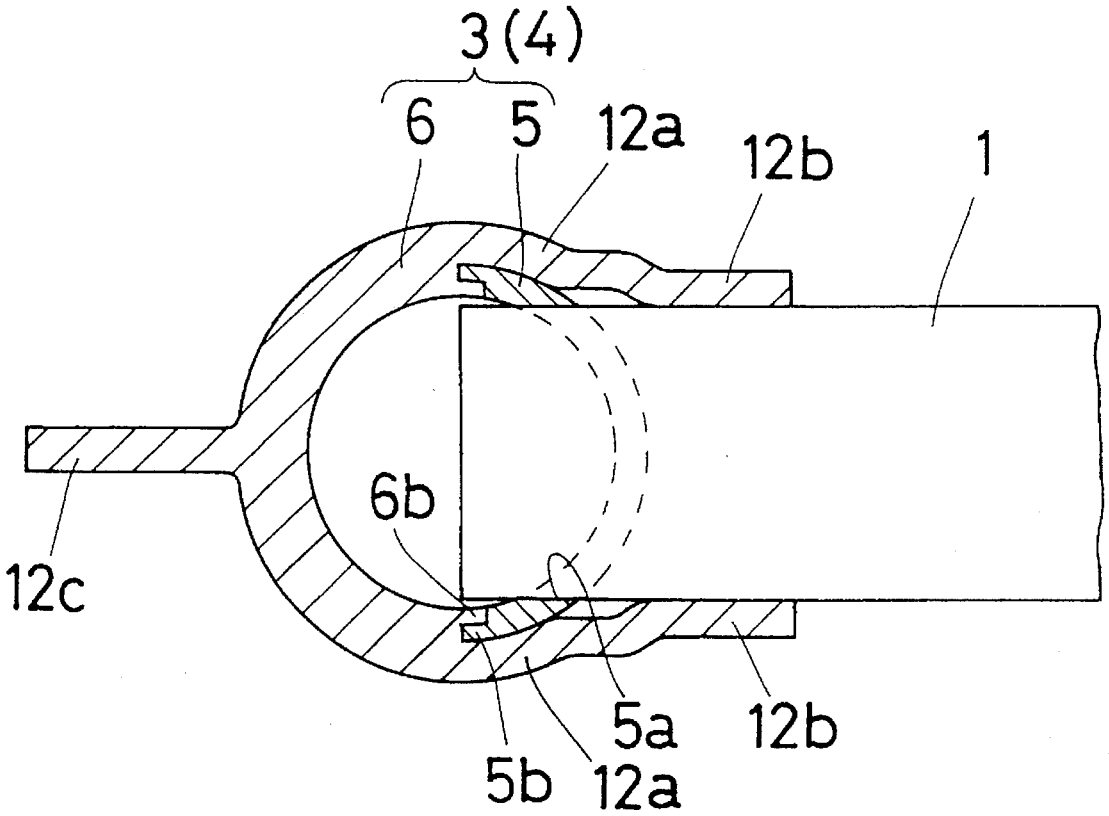
FIG. 25 shows another embodiment of the present invention, partly in cross-section and corresponding to FIG. 3.

FIG. 25 shows a structure which is provided herein from the second aspect of the invention.

Each of headers 3 and 4 is composed of an inner half 5 and an outer half 6 opposed thereto, with the inner one having a row of tube-insertion apertures, similarly to those in the preceding embodiment and its modifications.

The outer half 6 in this embodiment does however serve also as a bracket which has been described above. In detail, a fastenable rib 12*c* integral with the outer half 6 extends outwardly from a middle peripheral region thereof. This region is located intermediate the outer half's edges 6*b* which are coupled with the inner half's edges. The inner half 5 is embraced by a pair of embracing portions 12*a* of the outer half 6, with the portions 12*a* protruding from the edges 6*b* inwardly towards the inner half. Extensions 12*b* for contact with the tubes protrude inwardly from inner ends of the embracing portions. Either of or both the extensions may be dispensed with, if necessary and possible.

The edges 5*b* of the inner half 5 are disposed to abut against the edges 6*b* of the outer half 6, and the embracing portions 12*a* thereof grip the inner half at its outer peripheral regions, wherein the extensions 12*b* are in contact with the sides of tubes. The edges 5*b* and 6*b* of the halves 5 and 6 previously set in this state are brazed to each other, with the extensions 12*a* being also brazed to the inner half 5 so as to be integral therewith.

In order to facilitate the one-shot brazing of those members and portions within an oven, the inner half 5 may be composed of a core having both sides coated with a brazing agent layer. The outer half 6 may preferably be an extruded aluminum article, because it is easy to fabricate.

The fastenable rib 12*c* may be long enough to extend the full length of the outer half 6, or alternatively be shorter to protrude from a delimited zone thereof. Other features are the same as the first embodiment, and description thereof is abbreviated.

The second embodiment does not involve any separate bracket. Therefore, the number of constituent parts of the heat exchanger is reduced and the assembling thereof is simplified.

What is claimed is:

1. A heat exchanger comprising:

a plurality of tubes arranged in parallel with each other;

a pair of hollow headers disposed in spaced relation, each header having a row of tube-insertion apertures in which ends of the tubes are inserted;

at least one bracket attached to one of the headers;

the header to which the bracket is attached being composed of inner and outer halves facing one another, with the tube-insertion apertures being bored in the inner half;

the bracket comprising:

an embracing portion; and a fastenable rib, wherein the embracing portion of the bracket fits on the outer half of the header to which the bracket is attached, further extends beyond edges of the outer half and contacts both the halves, said embracing portion being fixedly secured to both halves of the header to which the bracket is attached;

edges of the inner half being joined to corresponding edges of the outer half to form a continuous, curved outer surface for the header at the connections between the two halves;

the embracing portion of the bracket having its entire length in contact with an outer surface of the outer half and with an outer surface of the edges of the inner half.

2. A heat exchanger as defined in claim 1, wherein each half of each header is an aluminum pressed piece composed of an aluminum core sheet which has one or both sides covered with a brazing agent layer.

3. A heat exchanger as defined in claim 1, wherein edges of one of the halves of each header are of a stepped shape complementary with edges of the other half of the header.

4. A heat exchanger as defined in claim 1, wherein ends of the tubes are inserted in each of the headers to a depth flush with a plane including edges of one of the halves of the header, with the edge abutting against other edges of the other half of the header.

5. A heat exchanger as defined in claim 1, wherein the embracing portion of the bracket is of a shape closely fittable on the outer periphery of the header to which it is attached.

6. A heat exchanger as defined in claim 1, wherein the embracing portion of the bracket embraces the outer half of the header to which it is attached in its entirety and further extends beyond edges of the halves, with the edges mating one another so that both the halves are held by and adjoined to the embracing portion.

7. A heat exchanger as defined in claim 1, wherein the bracket further comprises at least one extension which protrudes towards the tubes so as to be in contact therewith.

8. A heat exchanger as defined in claim 1, wherein the bracket is shaped such that at least one cavity is formed between the bracket, the header to which the bracket is attached and the tubes and facing a boundary between the header and the tubes, so as to supply the boundary with a sufficient amount of a molten brazing agent.

9. A heat exchanger as defined in claim 1, wherein the bracket is an integral piece of an extruded aluminum.

10. A heat exchanger as defined in claim 1, wherein the bracket extends along and wholly covers the header to which it is attached except for an upper and lower ends thereof.

11. A heat exchanger as defined in claim 1, further comprising fins, and each fin being interposed between adjacent tubes.

12. A heat exchanger comprising:

a plurality of flat tubes disposed in spaced, substantially parallel relation;

a plurality of fins, each fin disposed between adjacent tubes;

a pair of headers disposed in spaced, substantially parallel relation at opposite ends of the tubes, each header defining, for each tube, an opening through which it receives the tube and establishes fluid communication with the tube;

one header including an inner half and an outer half, each half having edge portions facing and fixedly attached to edge portions of the other half, the inner half defining the tube receiving openings, the edge portions of the inner and outer halves being joined to form a substantially continuous outer surface for the one header in the area of the joint;

a bracket secured to the one header, the bracket including:

an embracing portion that extends along and contacts an outer periphery of the one header;

a fastenable rib that protrudes from the embracing portion;

an extension that protrudes from the embracing portion and contacts side surfaces of a plurality of the tubes;

the embracing portion extending completely around the outer half, beyond the edge portions of the outer half and being fixedly secured to the inner and outer halves.

13. The heat exchanger of claim 12, wherein the edge portions of the inner and outer halves have a stepped shape, the stepped edge portions of one half being complementary with the stepped edge portions of the other half.

* * * * *